US007293309B1

(12) United States Patent
Shih

(10) Patent No.: US 7,293,309 B1
(45) Date of Patent: Nov. 13, 2007

(54) AUTOMATICALLY OPERATED BED

(75) Inventor: Lung-Tan Shih, Lukang Town (TW)

(73) Assignee: Ruoey Lung Enterprise Corp., Changhua Hsien (TW)

( * ) Notice: Subject to any disclaimer, the term of this patent is extended or adjusted under 35 U.S.C. 154(b) by 0 days.

(21) Appl. No.: 11/520,249

(22) Filed: Sep. 13, 2006

(51) Int. Cl.
*A61G 7/015* (2006.01)

(52) U.S. Cl. ..... 5/618

(58) Field of Classification Search ..... 5/618, 5/722, 249–251
See application file for complete search history.

(56) References Cited

U.S. PATENT DOCUMENTS 4,928,332 A * 5/1990 Ogden et al. ..... 5/614
5,577,280 A * 11/1996 Elliott ..... 5/618
6,061,852 A * 5/2000 Bathrick et al. ..... 5/618
6,708,358 B2 * 3/2004 Hensley ..... 5/915

* cited by examiner

*Primary Examiner*—Alexander Grosz
*Assistant Examiner*—Bill Kelleher
(74) *Attorney, Agent, or Firm*—Alan Kamrath; Kamrath & Associates P.A.

(57) ABSTRACT

An automatically operated bed includes a support frame, a first frame, a first drive cylinder, a second frame, a second drive cylinder, an auxiliary frame, and a cushion. Thus, the first frame and the second frame are lifted or lowered by operation of the first drive cylinder and the second drive cylinder, so that the bed has a simplified construction, thereby decreasing the costs of fabrication. In addition, the auxiliary frame is disposed at a horizontal state by support of the push bar of the second frame until the auxiliary frame so that a user's lower leg is supported by the auxiliary frame in comfortable manner to prevent the user's leg from being bent excessively, thereby providing a comfortable sensation to the user.

14 Claims, 13 Drawing Sheets

AUTOMATICALLY OPERATED BED

BACKGROUND OF THE INVENTION

1. Field of the Invention

The present invention relates to a bed and, more particularly, to an automatically operated bed.

2. Description of the Related Art

A conventional automatically operated bed 60 in accordance with the prior art shown in FIGS. 11-13 comprises a support frame 63, a front frame 61 mounted on a front portion of the support frame 61, a front cushion 64 mounted on the front frame 61, a rear frame 62 mounted on a second portion of the support frame 61, a rear cushion 65 mounted on the rear frame 62, and a drive mechanism 66 mounted on the front frame 61 for moving the front cushion 64 and the rear cushion 65. The drive mechanism 66 includes a drive motor 661 to rotate a drive shaft 662 which drives a movable tube 663 to move forward and backward by rotation of the drive shaft 662, an elastic wire 664 having a first end secured to a distal end of the movable tube 663 and a second end secured to a hook 651 of the rear cushion 65, and a connecting bracket 67 having a top rested on the front cushion 64 and having a pivot arm 671 pivotally mounted on the distal end of the movable tube 663.

In operation, the drive motor 661 rotates the drive shaft 662 to drive a the movable tube 663 to retract inward, so that the pivot arm 671 of the connecting bracket 67 is pulled by the movable tube 663 to drive the front cushion 64 to bend, while the elastic wire 664 is pulled by the movable tube 663 to drive the rear cushion 65 to bend as shown in FIG. 13.

However, the drive mechanism 66 has a complicated construction, thereby increasing the costs of fabrication. In addition, the drive mechanism 66 has a complicated construction, thereby causing inconvenience in maintenance of the drive mechanism 66. Further, the elastic wire 664 is pulled by the movable tube 663 to drive the rear cushion 65 to bend, so that the user's legs supported by the rear cushion 65 are disposed at a bent state constantly, thereby providing an uncomfortable sensation to the user. Further, the front cushion 64 and the rear cushion 65 are operated simultaneously and cannot be operated individually according to the user's practical requirement, thereby causing inconvenience to the user.

BRIEF SUMMARY OF THE INVENTION

In accordance with the present invention, there is provided a bed, comprising a support frame, a first frame having a first portion pivotally mounted on a first portion of the support frame, a first drive cylinder having a first portion pivotally mounted on the support frame and a second portion provided with a retractable first drive rod pivotally mounted on a second portion of the first frame, a second frame having a first portion pivotally mounted on a second portion of the support frame, a second drive cylinder having a first portion pivotally mounted on the support frame and a second portion provided with a retractable second drive rod pivotally mounted on the second frame, an auxiliary frame having a first portion pivotally mounted on a second portion of the second frame and a second portion provided with two rollers, and a cushion enclosed around the first frame, the support frame, the second frame and the auxiliary frame.

The primary objective of the present invention is to provide an automatically operated bed, wherein the first frame and the second frame are lifted or lowered by operation of the first drive cylinder and the second drive cylinder, so that the bed has a simplified construction, thereby decreasing the costs of fabrication.

Another objective of the present invention is to provide an automatically operated bed, wherein the bed has a simplified construction, thereby facilitating maintenance of the bed.

A further objective of the present invention is to provide an automatically operated bed, wherein the auxiliary frame is pushed by the push bar of the second frame until the auxiliary frame is disposed at a horizontal state so that the user's lower leg is supported by the auxiliary frame in a smooth and comfortable manner to prevent the user's leg from being bent excessively, thereby providing a comfortable sensation to the user.

A further objective of the present invention is to provide an automatically operated bed, wherein the first drive cylinder and the second drive cylinder are operated individually or simultaneously so that the cushion is disposed at different bending states according to a user's practical requirement.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
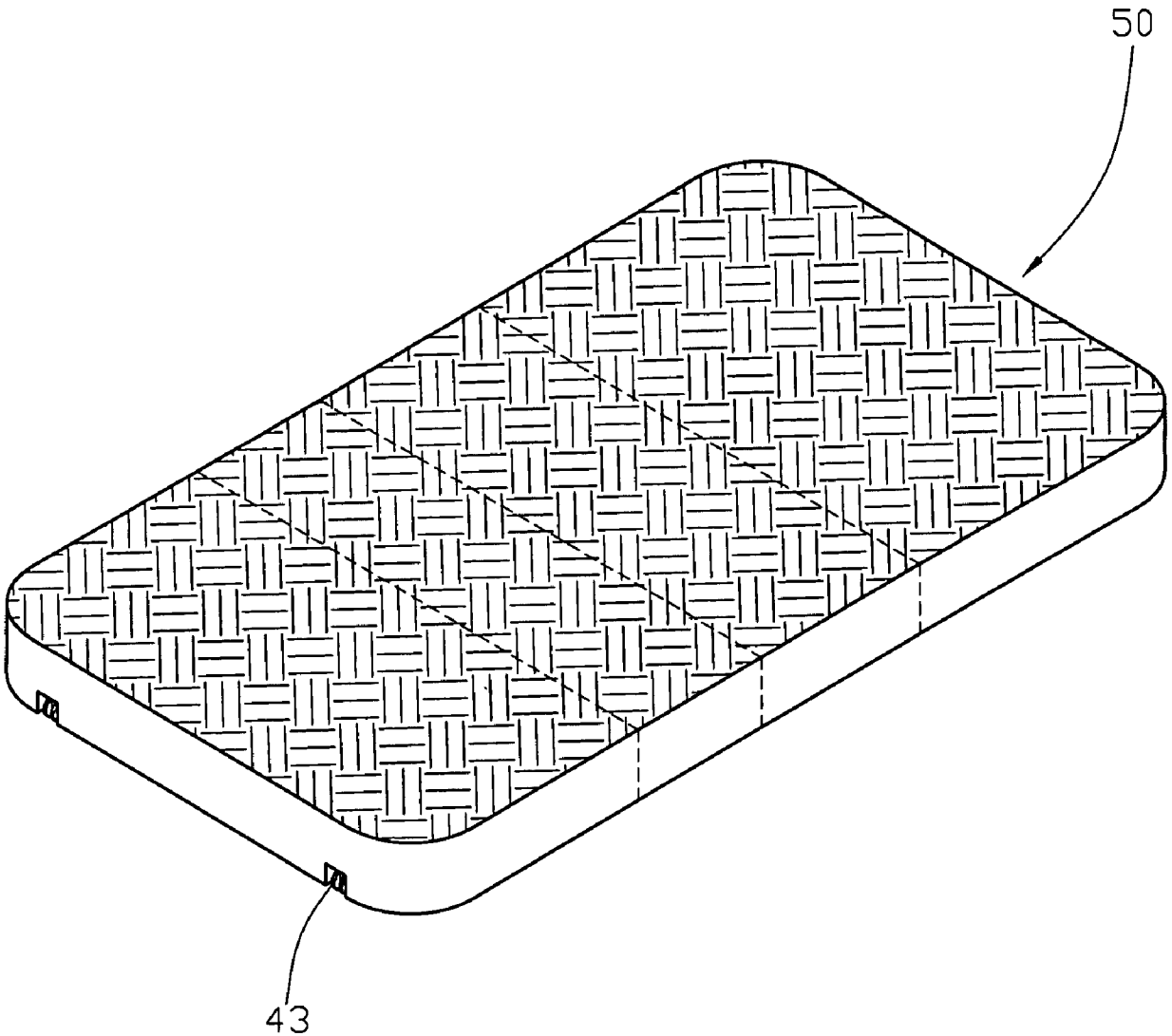
FIG. 1 is a perspective view of an automatically operated bed in accordance with the preferred embodiment of the present invention.
Figure 2:
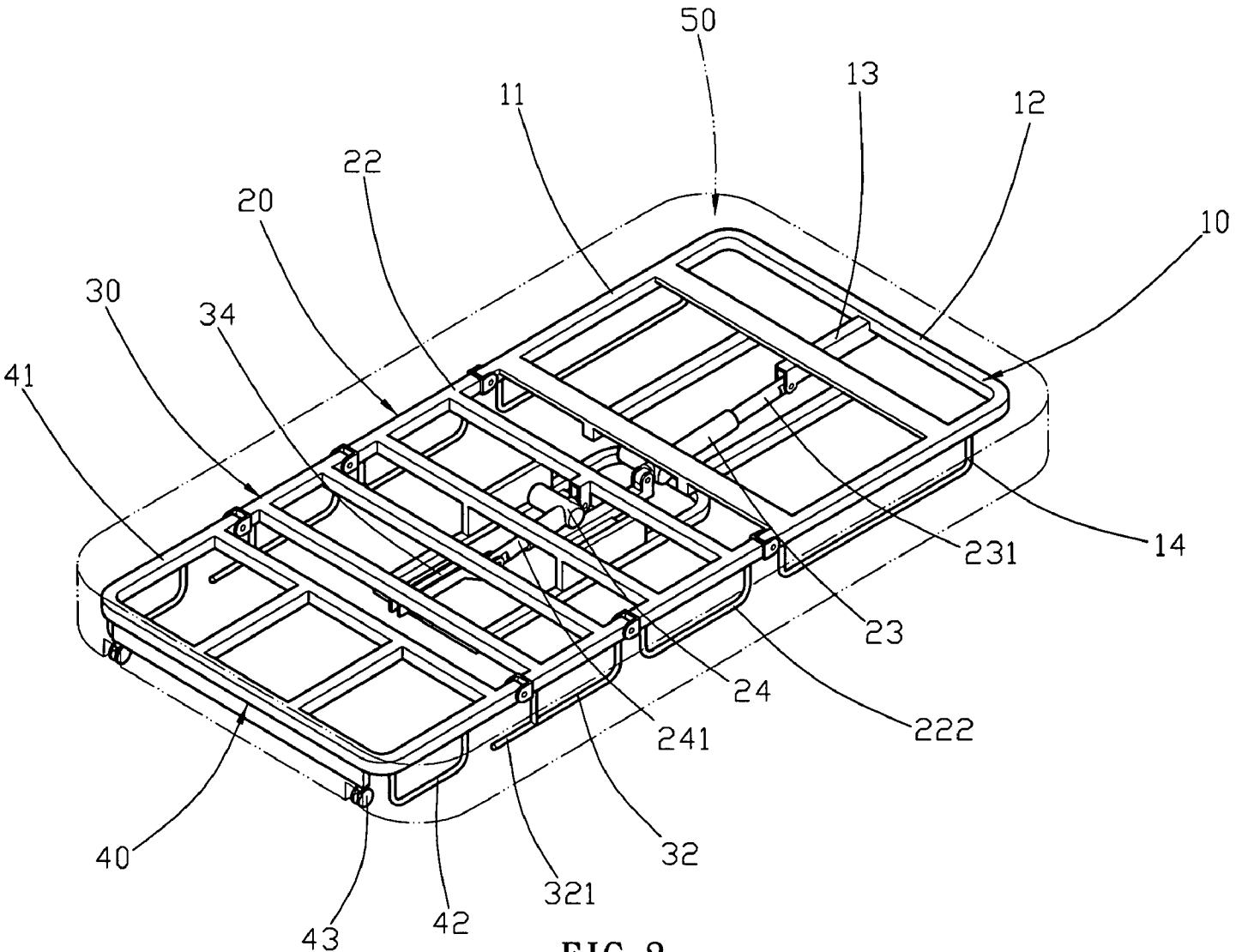
FIG. 2 is a perspective broken view of the automatically operated bed as shown in FIG. 1.
Figure 3:
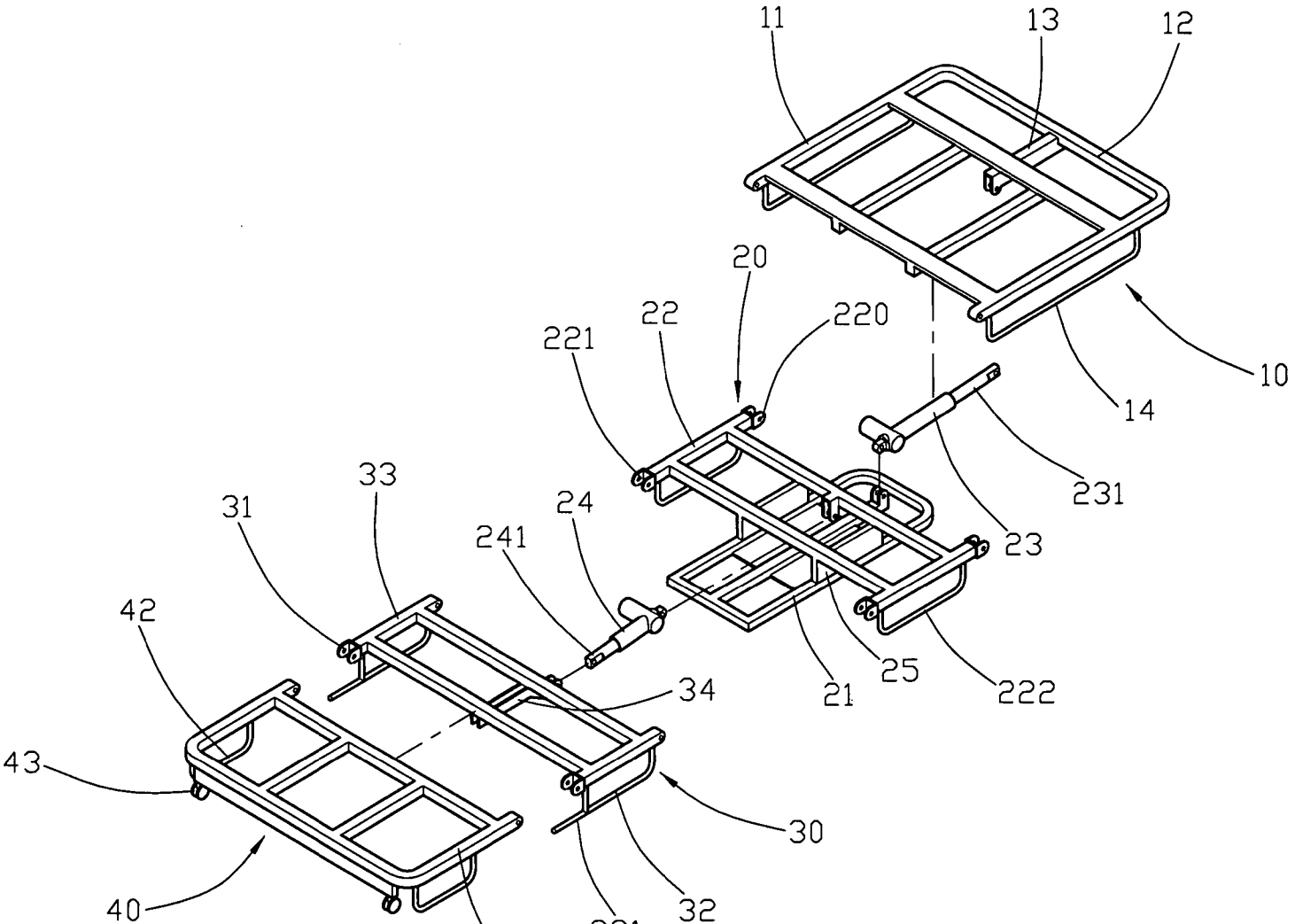
FIG. 3 is an exploded perspective view of the automatically operated bed as shown in FIG. 2.
Figure 4:
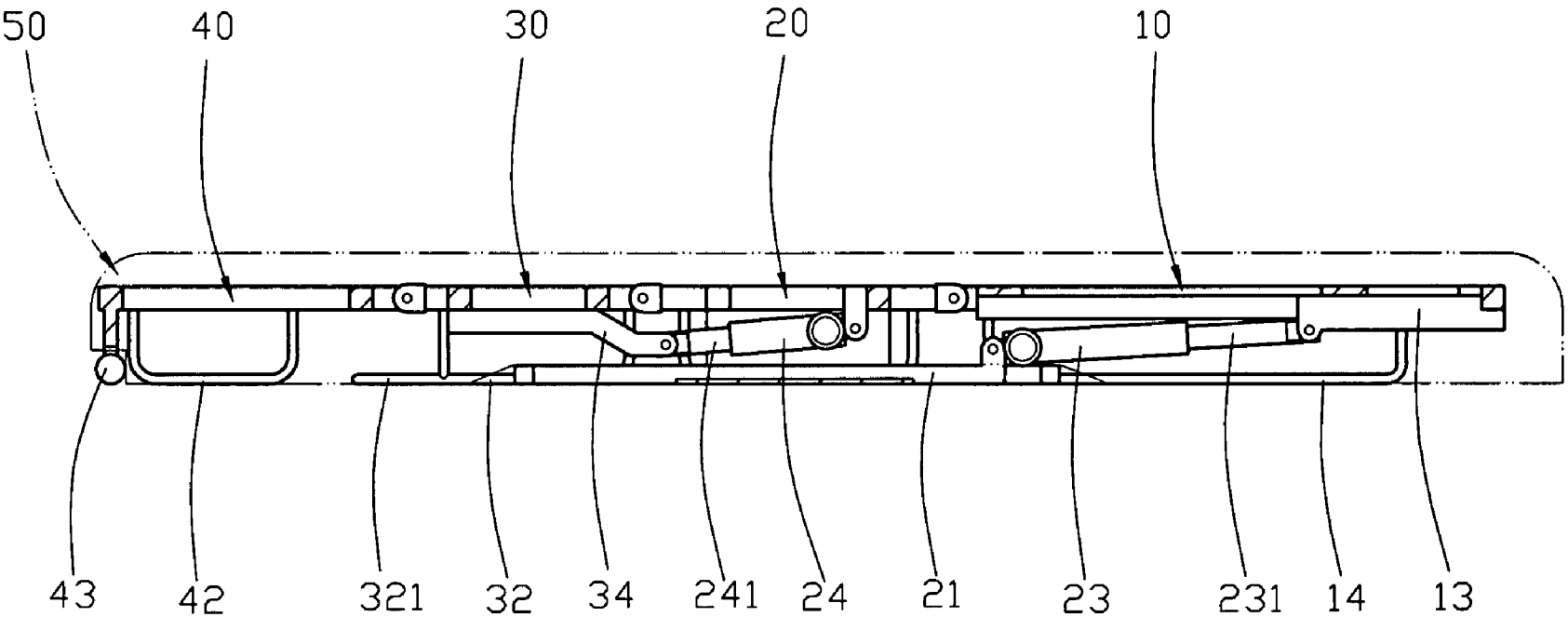
FIG. 4 is a plan view of the automatically operated bed as shown in FIG. 2.

Referring to the drawings and initially to FIGS. 1-4, an automatically operated bed, such as a motorized bed, in accordance with the preferred embodiment of the present invention comprises a support frame 20, a first frame 10 having a first portion pivotally mounted on a first portion of the support frame 20, a first drive cylinder 23 having a first portion pivotally mounted on the support frame 20 and a second portion provided with a retractable first drive rod 231 pivotally mounted on a second portion of the first frame 10, a second frame 30 having a first portion pivotally mounted on a second portion of the support frame 20, a second drive cylinder 24 having a first portion pivotally mounted on the support frame 20 and a second portion provided with a retractable second drive rod 241 pivotally mounted on the second frame 30, an auxiliary frame 40 having a first portion pivotally mounted on a second portion of the second frame 30 and a second portion provided with two rollers 43, and a cushion 50 enclosed around the first frame 10, the support frame 20, the second frame 30 and the auxiliary frame 40.

The support frame 20 includes an axially extending base 21 and a transverse rack 22 mounted on the base 21. The base 21 of the support frame 20 is exposed outwardly from the cushion 50. The transverse rack 22 of the support frame 20 is located above and spaced from the base 21 by a support bracket 25 which is located at a mediate portion of the base 21. The transverse rack 22 of the support frame 20 has a first portion provided with two first pivot seats 220 pivotally connected with the first portion of the first frame 10 and a second portion provided with two second pivot seats 221 pivotally connected with the first portion of the second frame 30. The transverse rack 22 of the support frame 20 has two opposite sides each provided with a downward extending resting portion 222 rested on the cushion 50 to stretch the cushion 50.

The first frame 10 has two opposite sides 11 each provided with a downward extending resting portion 14 rested on the cushion 50 to stretch the cushion 50. The second portion of the first frame 10 is provided with a transverse bar 12 which has a bottom provided with a pivot arm 13 extending toward the support frame 20.

Figure 6:
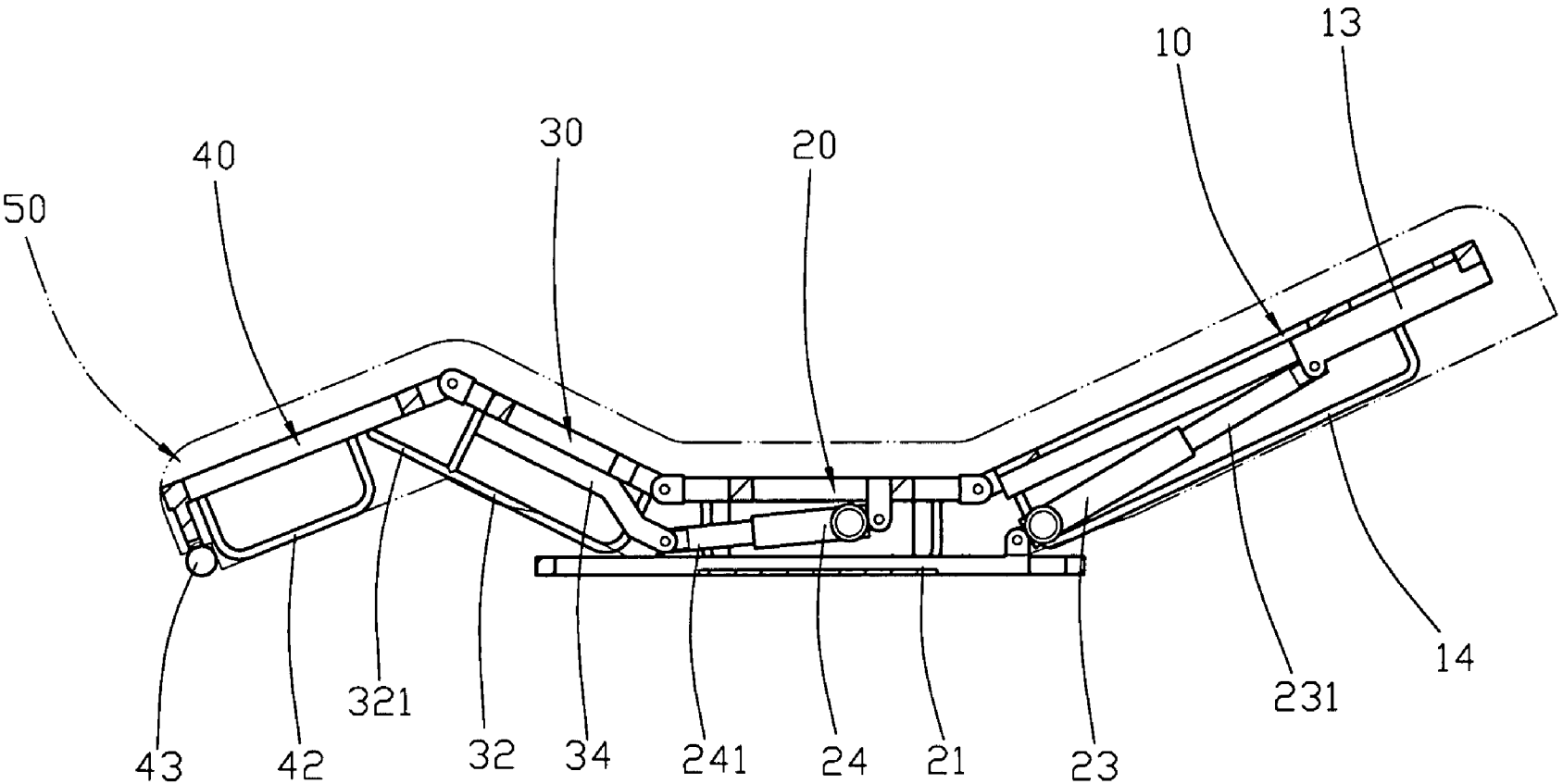
FIG. 6 is a schematic operational view of the automatically operated bed as shown in FIG. 4.

The second frame 30 has two opposite sides 33 each provided with a downward extending resting portion 32 rested on the cushion 50 to stretch the cushion 50. The resting portion 32 of the second frame 30 is provided with a push bar 321 extending toward the auxiliary frame 40 and movable to rest on a bottom of the auxiliary frame 40 as shown in FIG. 6 when the auxiliary frame 40 is pivoted downward relative to the second frame 30. The second frame 30 has a bottom provided with a pivot arm 34 extending toward the support frame 20. The second portion of the second frame 30 is provided with two pivot bases 31 pivotally connected with the first portion of the auxiliary frame 40.

The first drive cylinder 23 and the second drive cylinder 24 are operated individually or simultaneously. The first portion of the first drive cylinder 23 is pivotally mounted on the base 21 of the support frame 20. The first drive rod 231 of the first drive cylinder 23 has a distal end pivotally connected with the pivot arm 13 of the first frame 10. The first portion of the second drive cylinder 24 is pivotally mounted on the transverse rack 22 of the support frame 20. The second drive rod 241 of the second drive cylinder 24 has a distal end pivotally connected with the pivot arm 34 of the second frame 30. The second drive rod 241 of the second drive cylinder 24 and the first drive rod 231 of the first drive cylinder 23 are directed two opposite directions.

The auxiliary frame 40 has two opposite sides 41 each provided with a downward extending resting portion 42 rested on the cushion 50 to stretch the cushion 50. The rollers 43 of the auxiliary frame 40 are exposed outwardly from the cushion 50.

Figure 5:
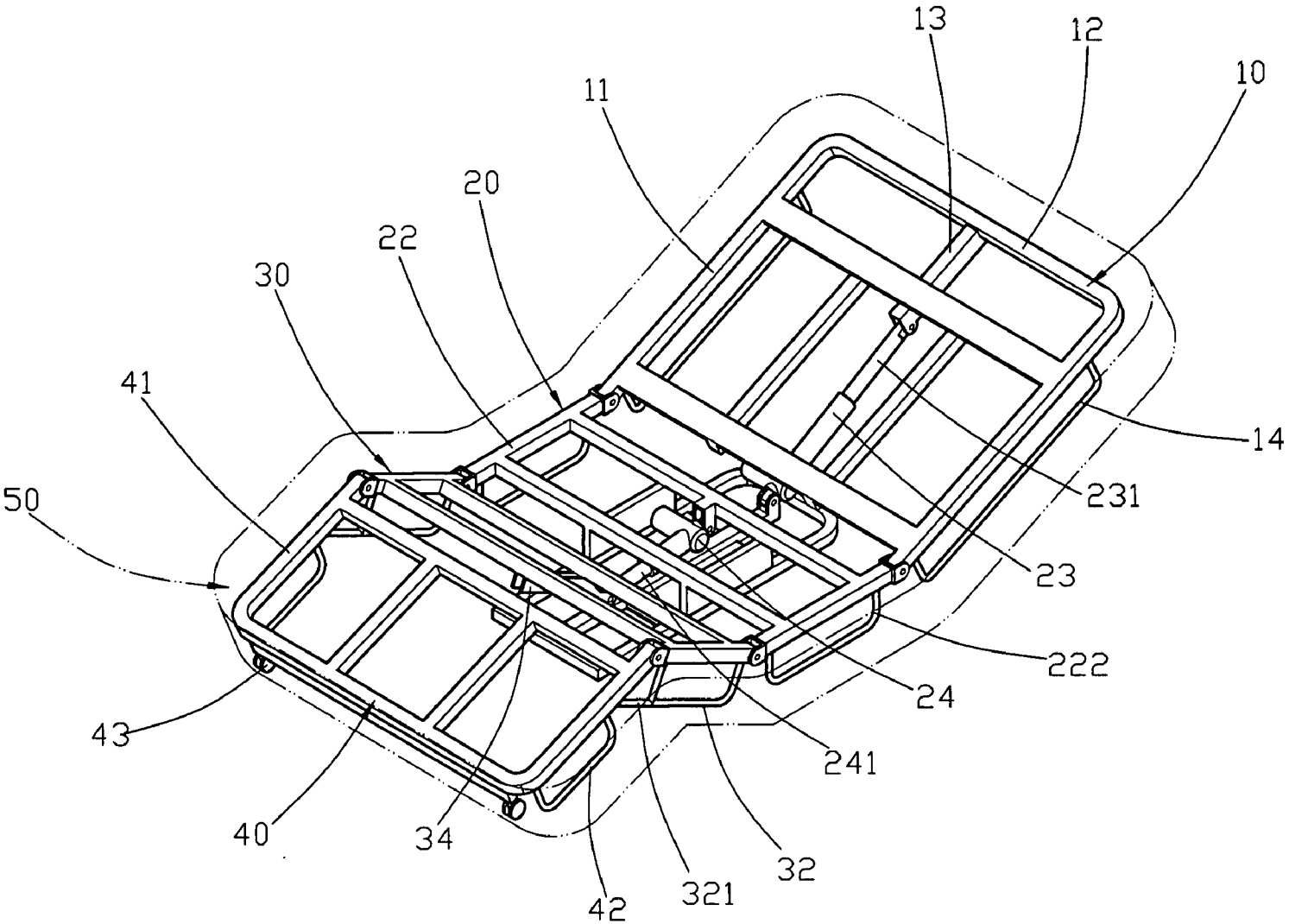
FIG. 5 is a schematic operational view of the automatically operated bed as shown in FIG. 2.
Figure 7:
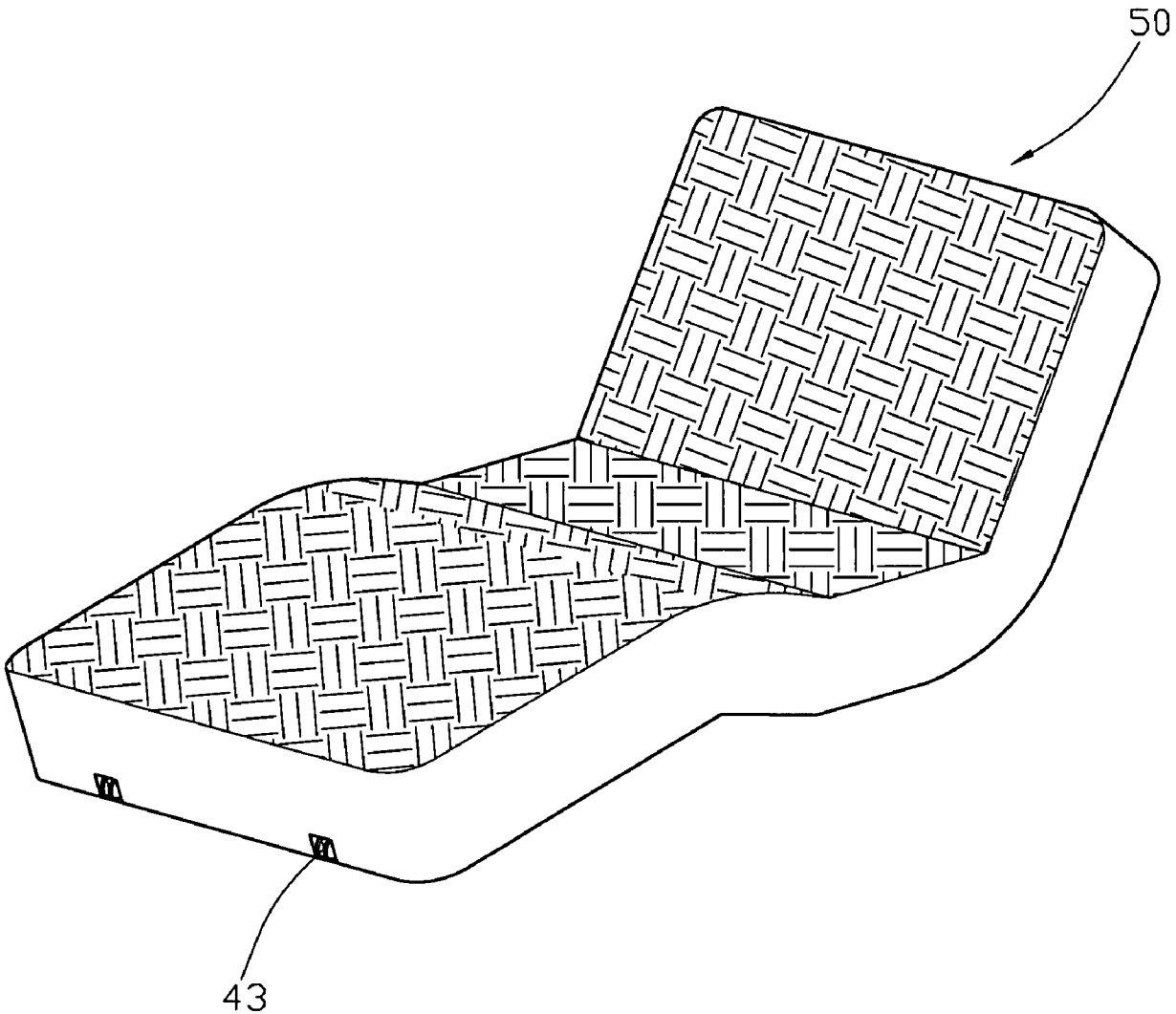
FIG. 7 is a schematic operational view of the automatically operated bed as shown in FIG. 1.

In operation, referring to FIGS. 5-7 with reference to FIGS. 1-4, when the first drive cylinder 23 is operated, the first drive rod 231 of the first drive cylinder 23 is expandable outwardly to push the pivot arm 13 of the first frame 10 to pivot upward, so that the first frame 10 is pivoted upward relative to the support frame 20 to lift and bend the front portion of the cushion 50 so as to support a user's head. In addition, when the second drive cylinder 24 is operated, the second drive rod 241 of the second drive cylinder 24 is expandable outwardly to push the pivot arm 34 of the second frame 30 to pivot upward, so that the second frame 30 is pivoted upward relative to the support frame 20 to lift and bend the mediate portion of the cushion 50 so as to support the user's upper leg. At the same time, the auxiliary frame 40 is pivoted downward and forward relative to the second frame 30 simultaneously when the second frame 30 is pivoted upward relative to the support frame 20 to lower and bend the rear portion of the cushion 50 so as to support the user's lower leg. At this time, the auxiliary frame 40 is movable on the ground smoothly by the rollers 43 of the auxiliary frame 40.

Thus, the first drive cylinder 23 and the second drive cylinder 24 are operated individually or simultaneously so that the cushion 50 is disposed at different bending states according to a user's requirement, thereby providing a comfortable sensation to the user.

As shown in FIG. 6, the auxiliary frame 40 is pivoted downward and forward relative to the second frame 30 until the push bar 321 of the second frame 30 is rested on the bottom of the auxiliary frame 40, so that the auxiliary frame 40 is supported by the push bar 321 of the second frame 30 and disposed at an inclined state.

Figure 8:
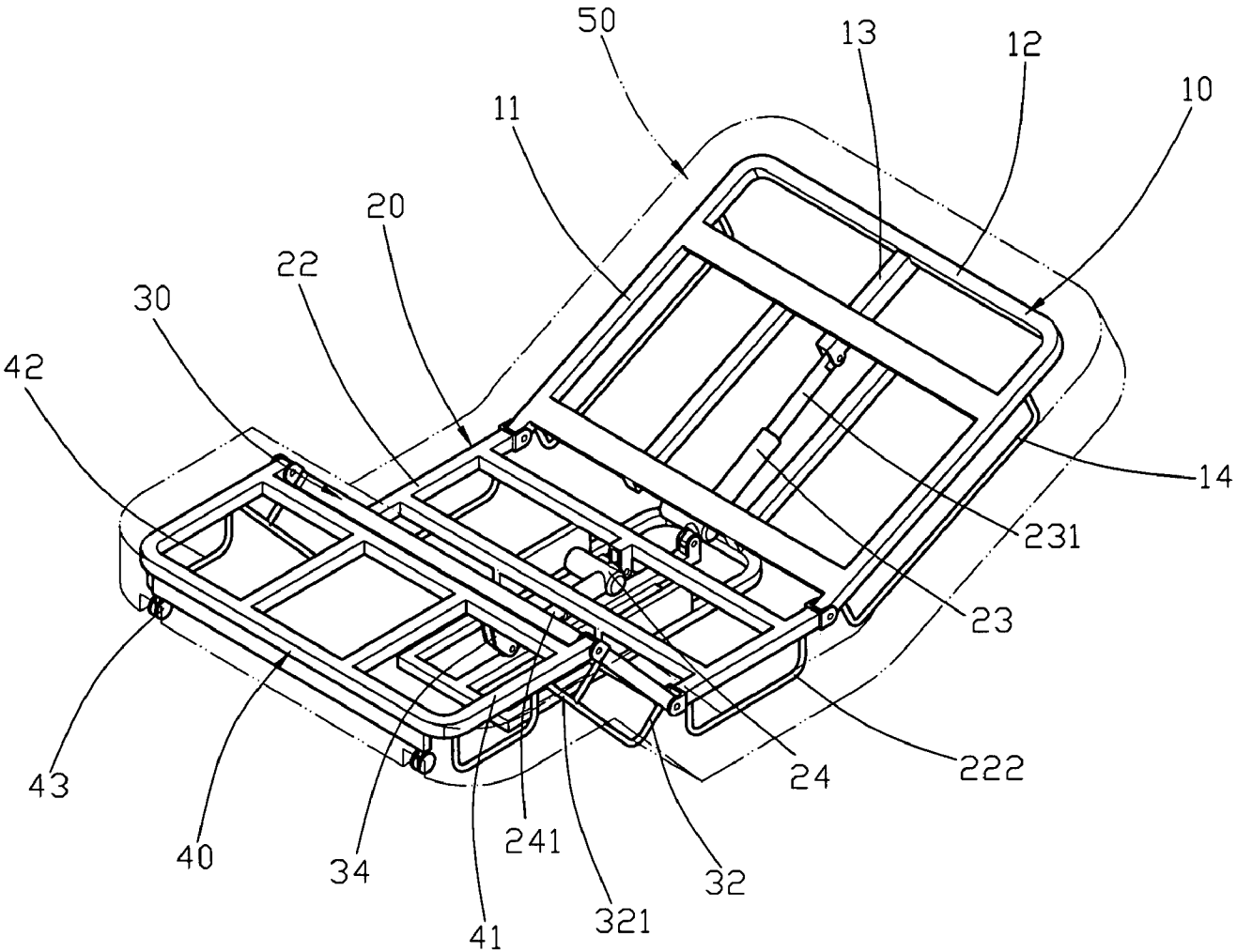
FIG. 8 is a schematic operational view of the automatically operated bed as shown in FIG. 5.
Figure 9:
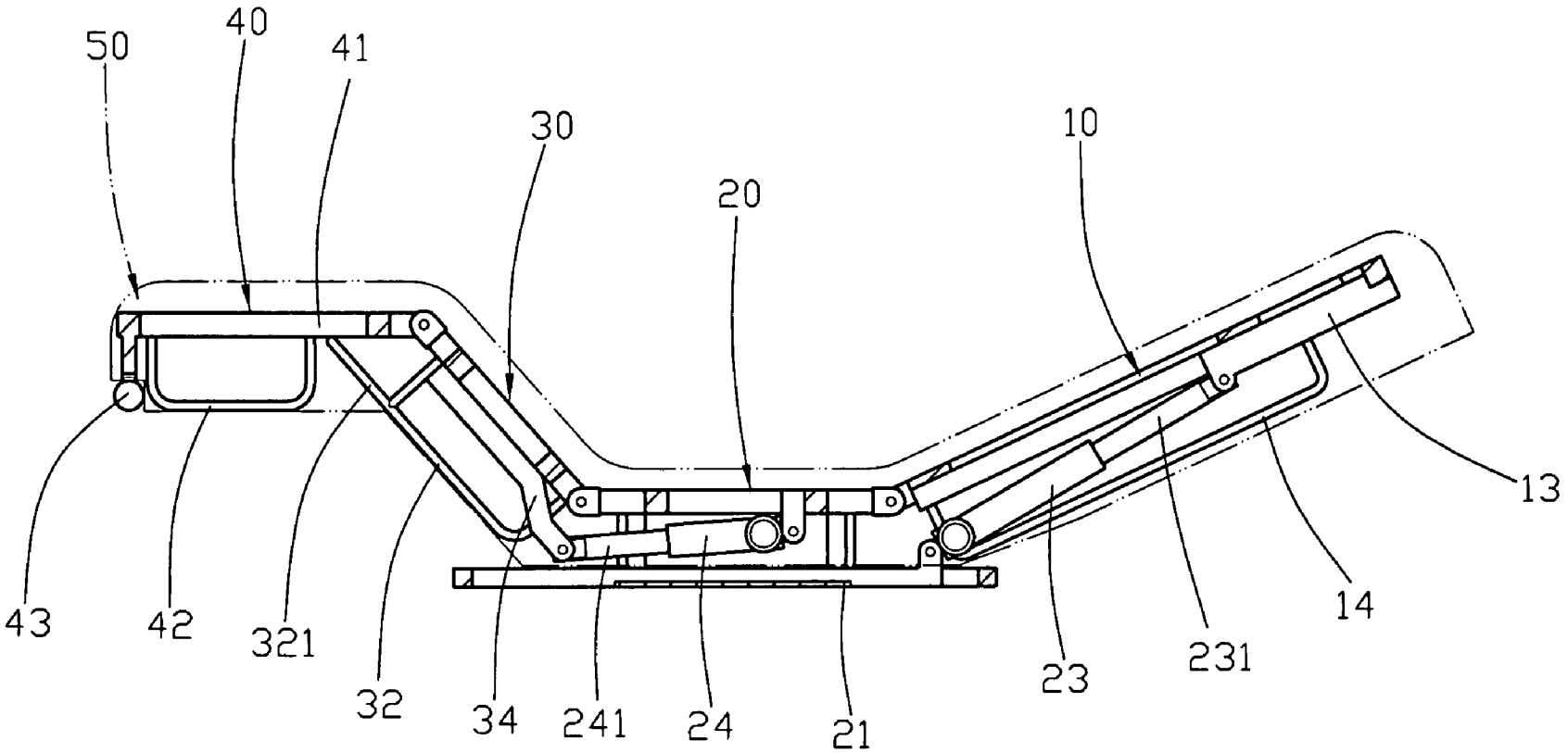
FIG. 9 is a schematic operational view of the automatically operated bed as shown in FIG. 6.
Figure 10:
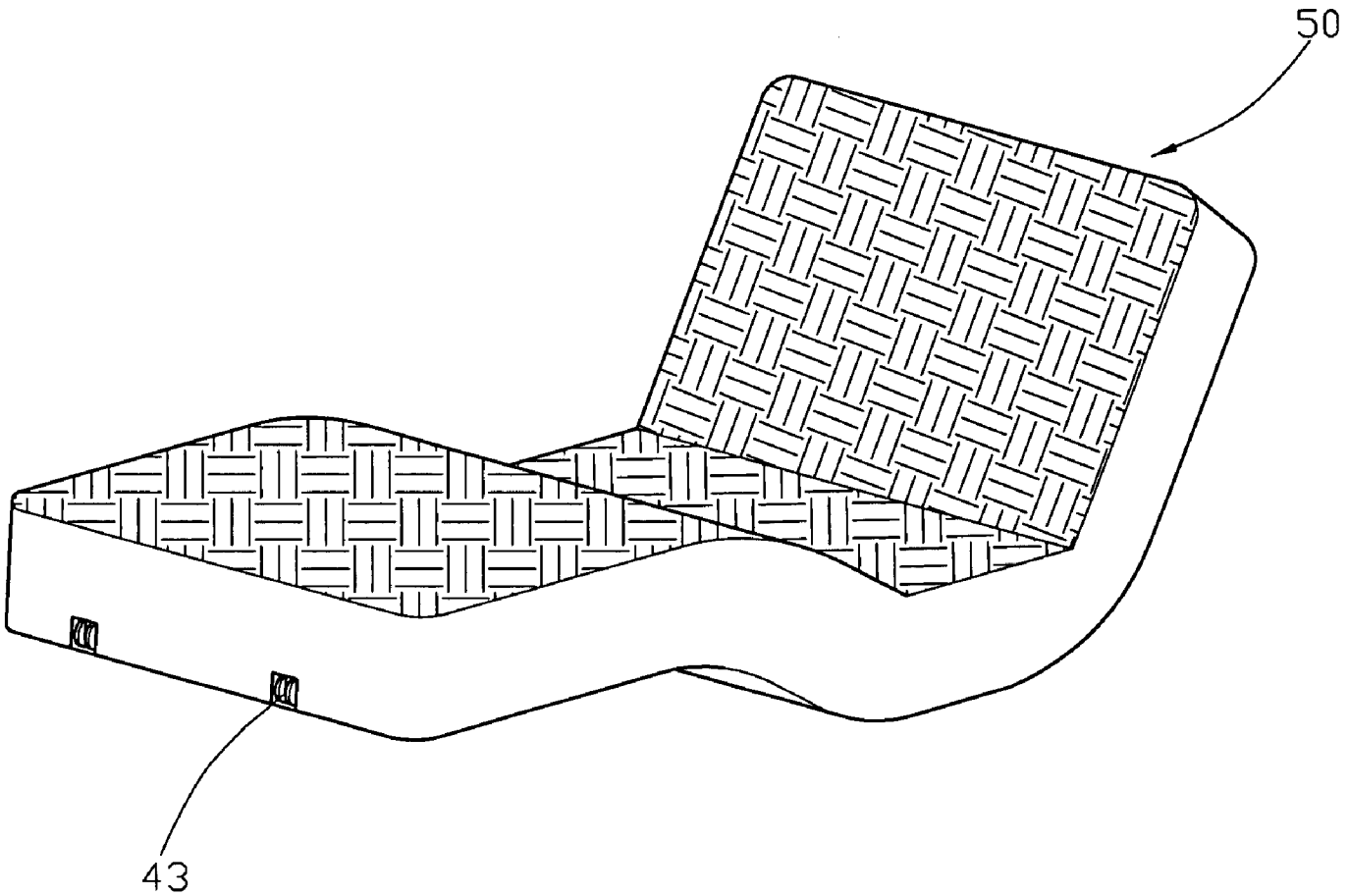
FIG. 10 is a schematic operational view of the automatically operated bed as shown in FIG. 7.
Figure 11:
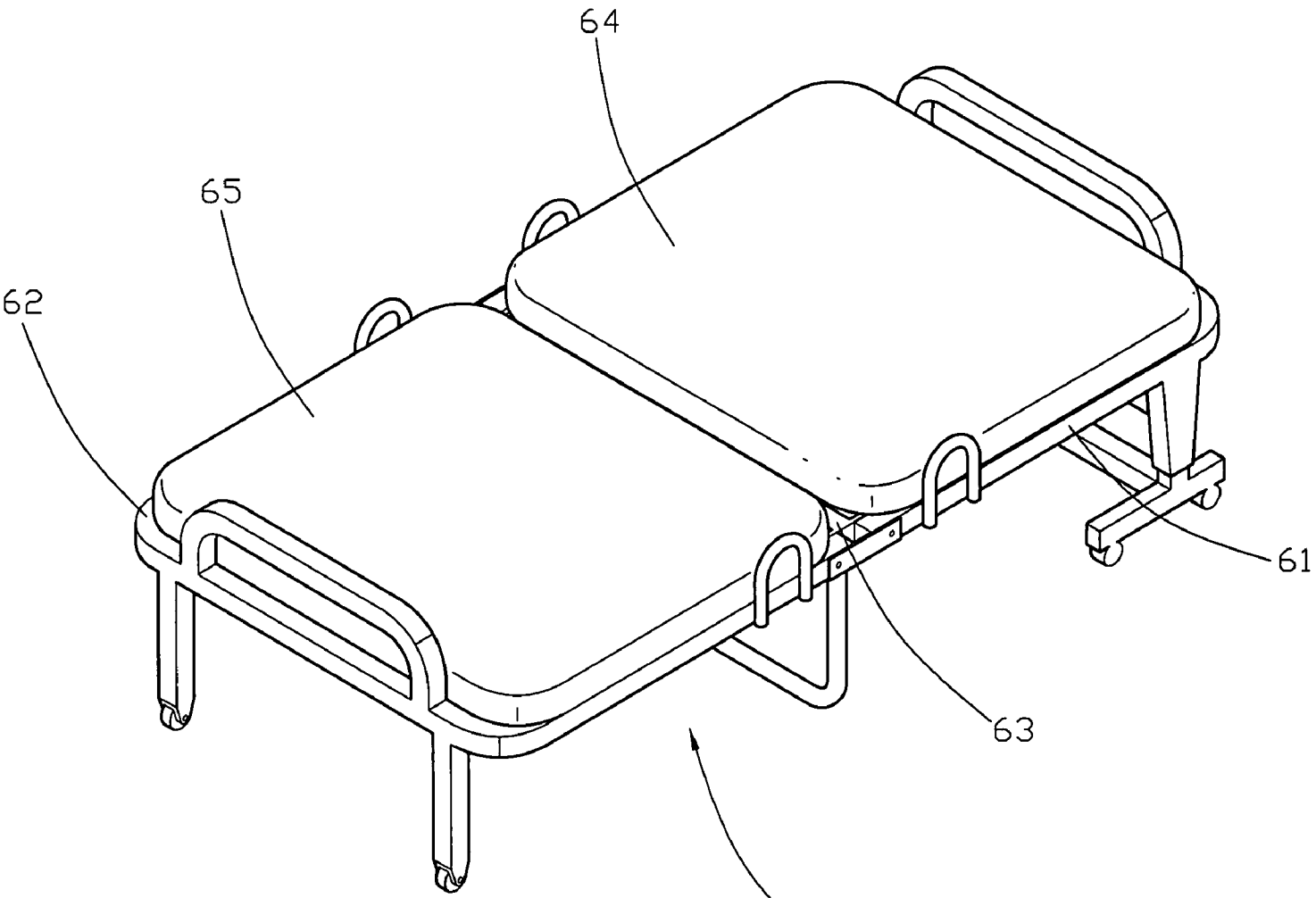
FIG. 11 PRIOR ART
FIG. 11 is a perspective view of a conventional automatically operated bed in accordance with the prior art.
Figure 12:
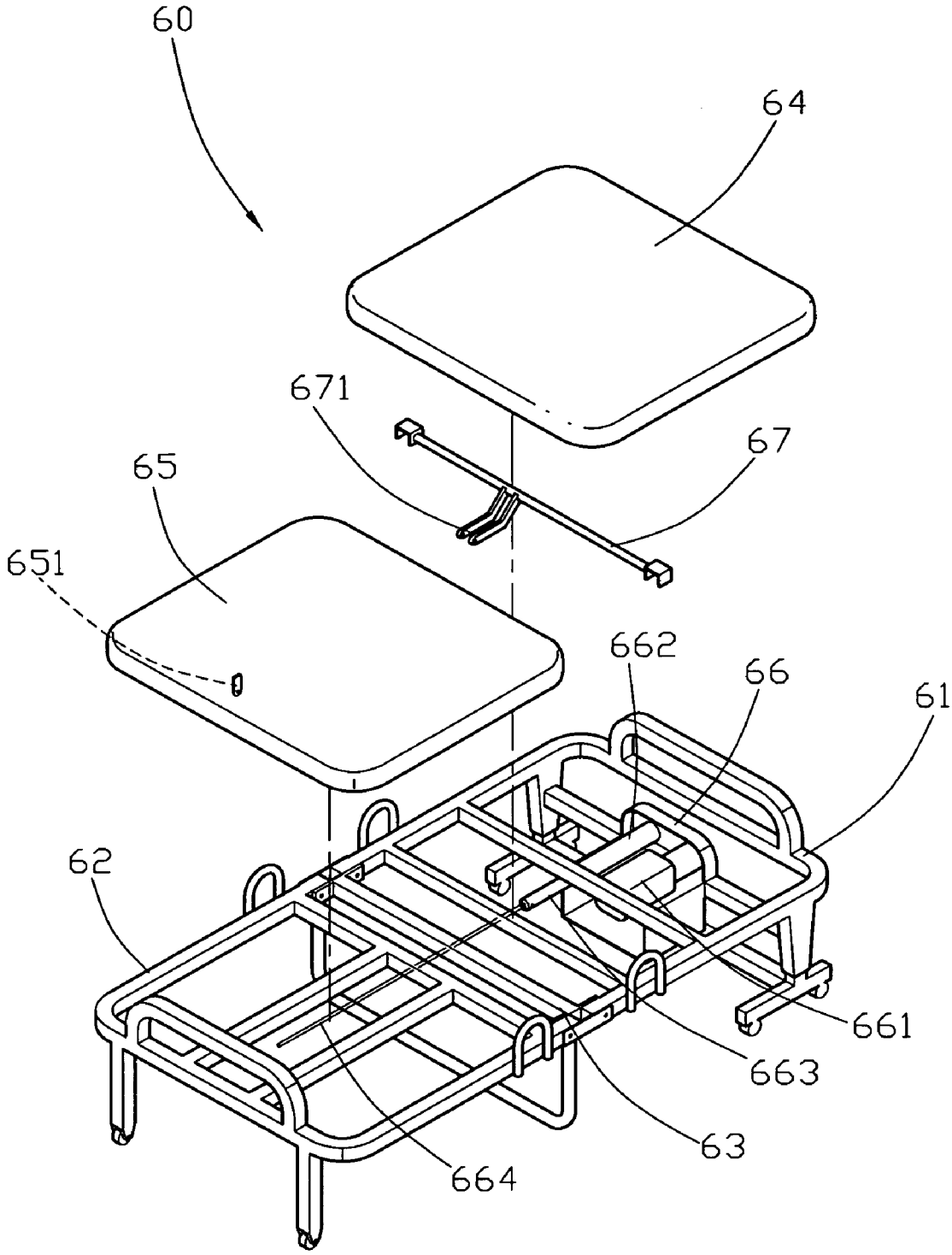
FIG. 12 PRIOR ART
FIG. 12 is an exploded perspective view of the conventional automatically operated bed as shown in FIG. 11.
Figure 13:
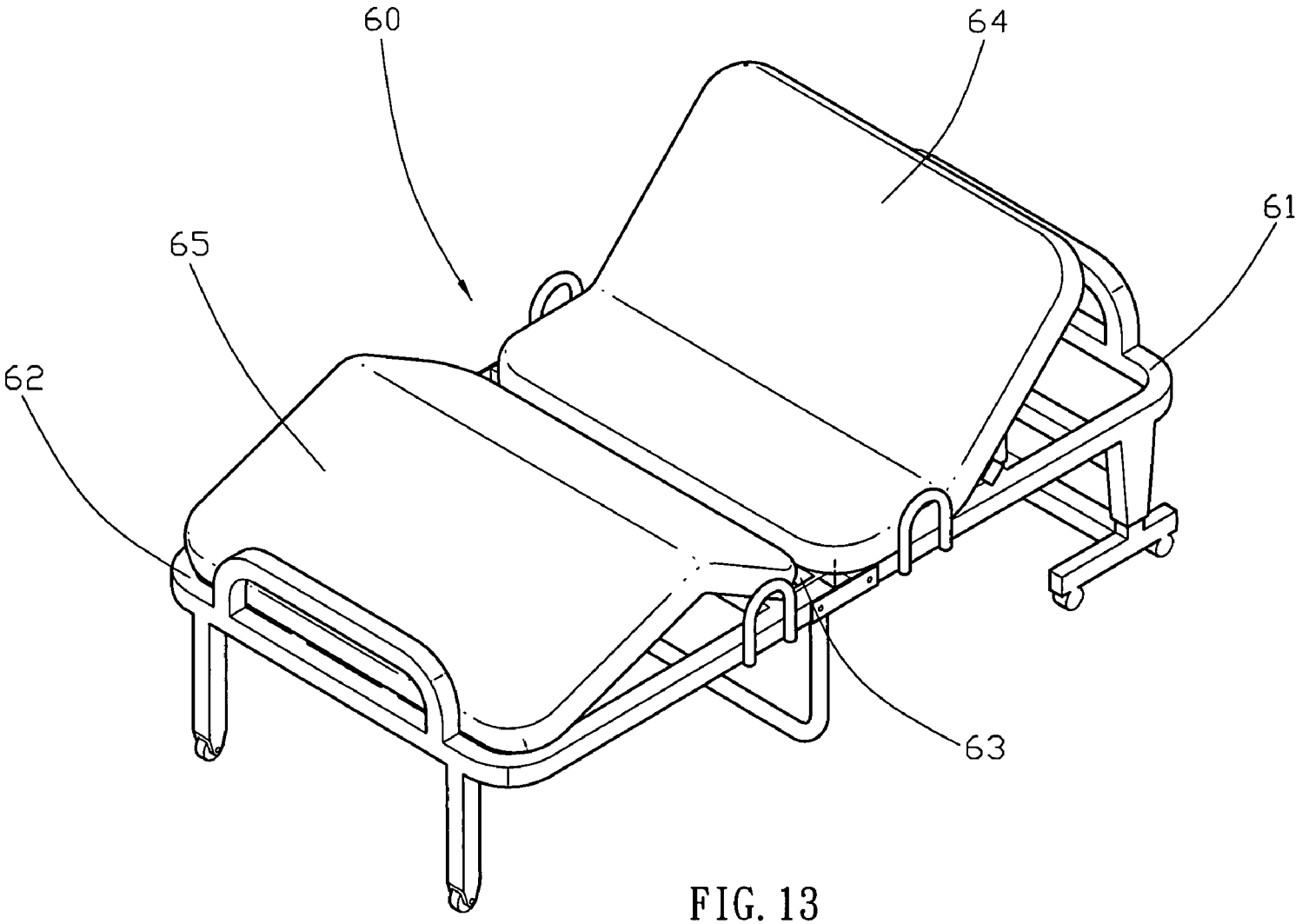
FIG. 13 PRIOR ART
FIG. 13 is a perspective operational view of the conventional automatically operated bed as shown in FIG. 11.

Referring to FIGS. 8-10, when the second frame 30 is pivoted upward successively relative to the support frame 20, the auxiliary frame 40 is pushed by the push bar 321 of the second frame 30 to move upward and backward relative to the support frame 20 until the auxiliary frame 40 is disposed at a horizontal state as shown in FIG. 9 so as to support the user's lower leg in a smooth and comfortable manner.

Accordingly, the first frame 10 and the second frame 30 are lifted or lowered by operation of the first drive cylinder 23 and the second drive cylinder 24, so that the bed has a simplified construction, thereby decreasing the costs of fabrication. In addition, the bed has a simplified construction, thereby facilitating maintenance of the bed. Further, the auxiliary frame 40 is pushed by the push bar 321 of the second frame 30 until the auxiliary frame 40 is disposed at a horizontal state so that the user's lower leg is supported by the auxiliary frame 40 in a smooth and comfortable manner to prevent the user's leg from being bent excessively, thereby providing a comfortable sensation to the user. Further, the first drive cylinder 23 and the second drive cylinder 24 are operated individually or simultaneously so that the cushion 50 is disposed at different bending states according to a user's practical requirement.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A bed, comprising:

a support frame;

a first frame having a first portion pivotally mounted on a first portion of the support frame;

a first drive cylinder having a first portion pivotally mounted on the support frame and a second portion provided with a retractable first drive rod pivotally mounted on a second portion of the first frame;

a second frame having a first portion pivotally mounted on a second portion of the support frame;

a second drive cylinder having a first portion pivotally mounted on the support frame and a second portion provided with a retractable second drive rod pivotally mounted on the second frame;

an auxiliary frame having a first portion pivotally mounted on a second portion of the second frame and a second portion provided with two rollers;

a cushion enclosed around the first frame, the support frame, the second frame and the auxiliary frame;

wherein the second frame has two opposite sides each provided with a downward extending resting portion rested on the cushion to stretch the cushion;

the resting portion of the second frame is provided with a push bar extending toward the auxiliary frame and movable to rest on a bottom of the auxiliary frame when the auxiliary frame is pivoted downward relative to the second frame;

the first drive rod of the first drive cylinder is expandable outwardly to push the first frame to pivot upward, so that the first frame is pivoted upward relative to the support frame to lift and bend a front portion of the cushion, the second drive rod of the second drive cylinder is expandable outwardly to push the second frame to pivot upward, so that the second frame is pivoted upward relative to the support frame to lift and bend a mediate portion of the cushion, and the auxiliary frame is pivoted downward and forward relative to the second frame simultaneously when the second frame is pivoted upward relative to the support frame to lower and bend a rear portion of the cushion;

the auxiliary frame is pivoted downward and forward relative to the second frame until the push bar of the second frame is rested on the bottom of the auxiliary frame, so that the auxiliary frame is supported by the push bar of the second frame and disposed at an inclined state;

when the second frame is pivoted upward successively relative to the support frame, the auxiliary frame is pushed by the push bar of the second frame to move upward and backward relative to the support frame until the auxiliary frame is disposed at a horizontal state.

2. The bed in accordance with claim 1, wherein the support frame includes a base and a transverse rack mounted on the base.

3. The bed in accordance with claim 2, wherein the transverse rack of the support frame is located above and spaced from the base by a support bracket which is located at a mediate portion of the base.

4. The bed in accordance with claim 2, wherein the transverse rack of the support frame has a first portion provided with two first pivot seats pivotally connected with the first portion of the first frame and a second portion provided with two second pivot seats pivotally connected with the first portion of the second frame.

5. The bed in accordance with claim 2, wherein the transverse rack of the support frame has two opposite sides each provided with a downward extending resting portion rested on the cushion to stretch the cushion.

6. The bed in accordance with claim 2, wherein the first portion of the first drive cylinder is pivotally mounted on the base of the support frame.

7. The bed in accordance with claim 2, wherein the first portion of the second drive cylinder is pivotally mounted on the transverse rack of the support frame.

8. The bed in accordance with claim 1, wherein the first frame has two opposite sides each provided with a downward extending resting portion rested on the cushion to stretch the cushion.

9. The bed in accordance with claim 1, wherein the second portion of the first frame is provided with a transverse bar which has a bottom provided with a pivot arm extending toward the support frame, and the first drive rod of the first drive cylinder has a distal end pivotally connected with the pivot arm of the first frame.

10. The bed in accordance with claim 1, wherein the second frame has a bottom provided with a pivot arm extending toward the support frame, and the second drive rod of the second drive cylinder has a distal end pivotally connected with the pivot arm of the second frame.

11. The bed in accordance with claim 1, wherein the second portion of the second frame is provided with two pivot bases pivotally connected with the first portion of the auxiliary frame.

12. The bed in accordance with claim 1, wherein the first drive cylinder and the second drive cylinder are operated individually or simultaneously so that the cushion is disposed at different bending states.

13. The bed in accordance with claim 1, wherein the second drive rod of the second drive cylinder and the first drive rod of the first drive cylinder are directed two opposite directions.

14. The bed in accordance with claim 1, wherein the auxiliary frame has two opposite sides each provided with a downward extending resting portion rested on the cushion to stretch the cushion.

* * * * *